United States Patent [19]

Reimer

[11] Patent Number: 4,504,101

[45] Date of Patent: Mar. 12, 1985

[54] LOW INSERTION FORCE CONNECTION ARRANGEMENT

[75] Inventor: William A. Reimer, Wheaton, Ill.

[73] Assignee: GTE Automatic Electric Inc., Northlake, Ill.

[21] Appl. No.: 527,637

[22] Filed: Aug. 29, 1983

[51] Int. Cl.[3] ..... H01R 9/09

[52] U.S. Cl. ..... 339/17 L; 339/74 R; 339/75 MP; 339/176 MP

[58] Field of Search ..... 339/17 L, 17 LM, 74 R, 339/75 MP, 176 MP, 204, 205

[56] References Cited

U.S. PATENT DOCUMENTS

| | | | |
|---|---|---|---|
| 3,611,259 | 10/1971 | Palecek | 339/74 R |
| 4,176,900 | 12/1979 | Hines et al. | 339/176 MP |
| 4,230,388 | 10/1980 | Thierry et al. | 339/74 R |
| 4,274,699 | 6/1981 | Keim | 339/176 MP |
| 4,275,944 | 6/1981 | Sochor | 339/74 R |
| 4,327,955 | 5/1982 | Minter | 339/75 MP |
| 4,400,049 | 8/1983 | Schuck | 339/17 LM |

*Primary Examiner*—John McQuade

*Attorney, Agent, or Firm*—Robert J. Black; Gregory G. Hendricks

[57] ABSTRACT

A low insertion force arrangement for establishing a connection to a printed wiring board of the type including at least one printed wiring board terminal. The arrangement includes at least one connection spring including at least one actuator and at least one pivot point. A first embodiment includes an actuator engaging area located centrally on the spring between two pivot points which are located between a contact and a connection spring terminal. A second embodiment includes at least one connection spring including a pivot point centrally located on the spring between an actuator engaging area and a second pivot point both of which are located between a contact and a connection spring terminal. In both embodiments the contact is located at one end of each connection spring in alignment with a corresponding printed wiring board terminal. A connector body is provided including a groove adapted to receive and retain a printed wiring board. The connector body includes at least one cavity in which the connector spring is retained. An actuator engages the actuator engaging area to pivot the connection spring about its pivot point to engage the spring contacts with or disengage the spring contacts from the printed wiring board terminal.

15 Claims, 5 Drawing Figures

LOW INSERTION FORCE CONNECTION ARRANGEMENT

CROSS-REFERENCE TO RELATED APPLICATIONS

Related, commonly assigned, co-pending applications include "Printed Wiring Board File," Ser. No. 527,635, "Double File Printed Wiring Board Module," Ser. No. 527,634, "Printed Wiring Board Interconnect Arrangement," Ser. No. 527,636, "Low Insertion Force Connection Arrangement," Ser. No. 527,638, and "Low Insertion Force Connection Arrangement," Ser. No. 527,639, all filed concurrently herewith and invented by the same inventor.

BACKGROUND OF THE INVENTION

The present invention relates to arrangements for establishing connection to printed wiring boards and more particularly to low insertion force arrangement employing pivotally mounted connection springs for establishing connection to a printed wiring board.

Devices permitting connection to printed wiring boards are well known in the art. In this regard, zero insertion force, edge board connectors have been disclosed in U.S. Pat. No. 4,189,200 issued Feb. 19, 1980 to Yeager, et al, and U.S. Pat. No. 4,159,861 issued July 3, 1979 to Anhalt. These connectors include cantilevered contacts biased toward the printed wiring board and positioned out of engagement with the board for insertion purposes. Connectors including cantilevered contacts biased against the printed wiring board and temporarily retracted from contact with the board directly by means of an actuator are disclosed in U.S. Pat. No. 3,793,609 issued Feb. 19, 1974 to McIver, and U.S. Pat. No. 3,848,221 issued Nov. 12, 1974 to Lee. Finally, a low insertion force connector including cantilevered contacts biased out of engagement with the printed wiring board and positioned into engagement with the printed wiring board through the use of actuators is taught in U.S. Pat. No. 4,176,900 issued Dec. 4, 1979 to Heinz, et al.

The art cited is seen to teach various arrangements of cantilevered or resiliently biased contact springs for connecting to or interconnecting printed wiring boards.

SUMMARY OF THE INVENTION

The present invention provides a low insertion force arrangement for establishing a connection to a printed wiring board of the type including at least one connector terminal. The arrangement includes at least one connection spring, including a contact, at least one pivot point, a termination, and an actuator engaging area. The contact is engageably positioned relative to the printed wiring board terminal and the termination is included to permit connection to external points.

A fulcrum is positioned to engage the spring at the pivot points and an actuator is located proximate to the spring at the actuator engaging area. The actuator is positioned in a first position relative to the spring to pivot the spring and engage the contact with the printed wiring board terminal, and positioned in a second position relative to the spring to pivot the spring and disengage the contact from the printed wiring board terminal.

BRIEF DESCRIPTION OF THE DRAWING

Various features and advantages of a zero insertion force connection arrangement in accordance with the present invention will be apparent from the following description taken in conjunction with the accompanying drawing in which.

DETAILED DESCRIPTION OF THE INVENTION

Figure 1:
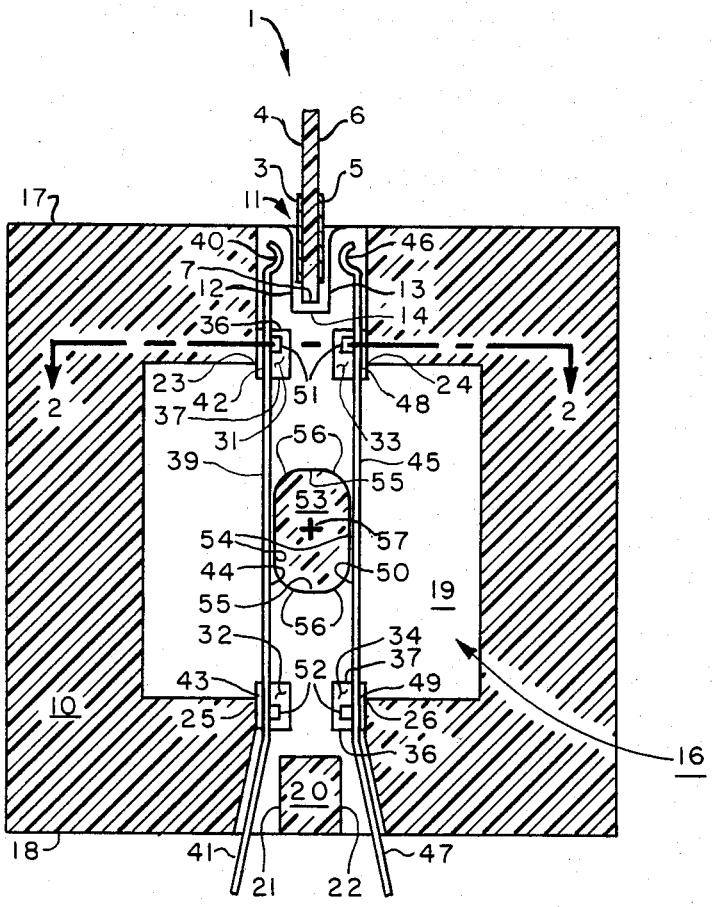
FIG. 1 is a cross sectional view of a first embodiment of a zero insertion force connection arrangement for establishing connection to a printed wiring board in accordance with the present invention.

Referring now to FIG. 1 there is shown a first arrangement for establishing connection to a printed wiring board 1. The printed wiring board 1 includes a first plurality of terminals 3 located on a first side 4 and a second plurality of terminals 5 located on a second side 6. The first terminals 3 and the second terminals 5 are located near an edge 7 of the printed wiring board 1.

Figure 2:
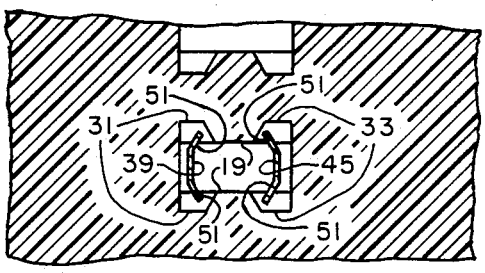
FIG. 2 is a sectional view taken along line 2—2 in FIG. 1.

A connector body 10 is provided with a groove 11 including a first wall 12, a second wall 13, and a floor 14. A plurality of spring receiving cavities 16 are formed in the connector body 10 in alignment with corresponding groups of one of each of the terminals 3 and 5. The cavities 16 extend between a first side 17 and a second side 18 of the connector body 10 and include a pair of parallel opposite walls 19 (such walls are shown in FIG. 2) and a guide block 20 located centrally within each of the cavities 16 at the second side 18. The guide block includes a first side 21 and a second side 22. A first fulcrum 23 and a second fulcrum 24 are each formed in each of the spring receiving cavities 16, between the opposite walls 19, near the first side 17 of the connector body 10, and near the first side 4 and the second side 6 of the printed wiring board 1 respectively. Similarly, a third fulcrum 25 and a fourth fulcrum 26 are each formed in each of the spring receiving cavities 16, between the opposite walls 19, near a second side 18 of the connector body 10 and near the first side 21 and the second side 22 of the guide block 20 respectively.

Referring to FIG. 2, a first pair of recesses 31 and a second pair of recesses 32 (shown in FIG. 1) are formed in the walls 19 of each of the spring receiving cavities 16 near the first side 4 of the printed wiring board 1 and the first side 21 of the guide block 20. Similarly, a third pair of recesses 33 and a fourth pair of recesses 34 (shown in FIG. 1) are formed in the walls 19 of each of the spring receiving cavities 16 near the second side 6 of the printed wiring board 1 and the second side 22 of the guide block 20. Referring again to FIG. 1, each of the recesses 31 through 34 is elongated and includes an outer edge 36 and an inner edge 37. Each of the spring receiving cavities 16 intersects the printed wiring board receiving groove 11.

Each of the spring receiving cavities 16 includes an elongated first connection spring 39 positioned therein.

Each of the first springs 39 includes a contact 40, a connection spring terminal 41 positioned at opposite ends thereof. The contact 40 of each of the first springs 39 is positioned proximate to a corresponding one of the first contacts 3 of the printed wiring board 1 and the terminal 41 extends beyond the second side 18 of the connector body 10 to permit connection to external points (not shown) by commonly known means (also not shown) such as wire connection. The first side 21 of guide block 20 is located to limit movement of the first spring 39 with respect to the connector body 10 while the connection to terminal 41 from external points is being accomplished.

Each of the first springs 39 includes a first pivot point 42 and a second pivot point 43, both pivot points positioned on a side of the spring facing away from the printed wiring board 1 and located between the contact 40 and the terminal 41. An actuator engaging area 44 is positioned on a side of each of the first springs 39 facing the printed wiring board 1 and located between the pivot points 42 and 43. Similarly, each of the spring receiving cavities 16 includes a second connection spring 45 including a contact 46 positioned proximate to a corresponding one of the second terminals 5 of printed wiring board 1 and a terminal 47 extending beyond the second side 18 of the connector body 10 to permit connection to external points (not shown) by commonly known means (also not shown) such as wire connection. The second side 22 of the guide block 20 is located to limit movement of the second spring 39 with respect to the connector body 10 while the connection to terminal 47 from external points is being accomplished.

Each of the second springs 45 includes a first pivot point 48 and a second pivot point 49, both pivot points positioned on a side of the spring facing away from the printed wiring board 1 and located between the first contact 46 and the terminal 47. An actuator engaging area 50 is positioned on a side of the second spring 45 facing towards the printed wiring board 1 and located between the pivot points 48 and 49. The pivot points 42, 43, 48, and 49 are positioned to engage fulcrums 23, 24, 25, and 26, respectively, when the springs 39 and 45 are operated as described below.

Referring to FIG. 2, each of the first springs 39 and the second springs 45 includes a first pair of retaining fingers 51 and a second pair of retaining fingers 52 (see FIG. 1) to retain each of the first springs 39 and each of the second springs 45 within each of their respective spring receiving cavities 16 while permitting spring movement about the pivot points 42, 43, 48, and 49. Referring again to FIG. 1, the first pairs of retaining fingers 51 are attached to each of the first springs 39 near the first pivot point 42 and to each of the second springs 45 near the first pivot point 48. Similarly, the second pairs of retaining fingers 52 are attached to each of the first springs 39 near each of the second pivot points 43 and to each of the second springs 45 near each of the second pivot points 49.

An actuator 53 is included between each corresponding pair of the first actuator engaging areas 44 and the second actuator engaging areas 50 and includes a pair of low points 54 and a pair of high points 55 connected by a plurality of cam surfaces 56. Each of the actuators 53 is arranged to pivot about a pivot point 57.

The connector of the present invention is operated by rotating the actuator 53 to place the low points 54 in contact with the actuator engaging areas 44 and 50. In this position, the first spring 39 and the second spring 45 are in their unactuated positions. The contacts 40 and 46 are out of engagement with the first contacts 3 and the second contacts 5 of the printed wiring board 1. The first spring 39 is held in place while unactuated by the first retaining fingers 51 and the second retaining fingers 52 of the spring acting against the outer edges 36 of the first recesses 31 and the second recesses 32, respectively. Similarly, the second spring 45 is held in place while unactuated by the first retaining fingers 51 and the second retaining fingers 52 of the spring acting against the outer edges 36 of the third recesses 33 and the fourth recesses 34, respectively.

The printed wiring board 1 may now be inserted into the groove 11 with low insertion force to the point where the edge 7 abuts the groove floor 14. Once inserted, the first terminal 3 of the printed wiring board 1 may be connected to the terminal 41 and the second terminal 5 of the printed wiring board 1 may be connected to the terminal 47 by rotating the actuator 53. In this regard, the actuator 53 is rotated 90 degrees in either direction to place the high points 55 in contact with the actuator engaging areas 44 and 50, thus deflecting the first and second springs 39 and 45.

As the springs 39 and 45 are deflected, the actuator engaging areas 44 and 50 move away from each other causing the springs to pivot about their first pivot points 42 and 48 acting against the fulcrums 23 and 24, respectively, and their second pivot points 43 and 49 acting against the fulcrums 25 and 26, respectively, thus moving the contacts 40 and 46 into engagement with the terminals 3 and 5 of the printed wiring board 1. Following engagement of the contacts 40 and 46 with the printed wiring board terminals 3 and 8, further movement of the actuator engaging areas 44 and 50 away from each other causes the spring segments between the actuator engaging areas and their respective contacts to deflect and wipe the contacts against their respective terminals. Wiping action of the contacts 40 and 46 of the first spring 39 and the second spring 45, respectively, is controlled by action of the first fingers 51 of the first and second springs 39 and 45 against the inner edges 37 of the first and third recesses 31 and 33, respectively, and action of the second fingers 52 of the first and second springs 39 and 45 against the inner edges 37 of the second and the fourth recesses 32 and 34, respectively.

While a rotational type of actuator has been described in the first embodiment, it will be appreciated that other types of actuators may be used to deflect the actuator engaging areas 44 and 50 away from each other to effect engagement of the connector spring contacts with the printed wiring board terminals. In this regard, an actuator bar (not shown) including a chisel point having faces facing the actuator engaging areas 44 and 50 may be inserted between the areas to deflect them away from each other.

Figure 3:
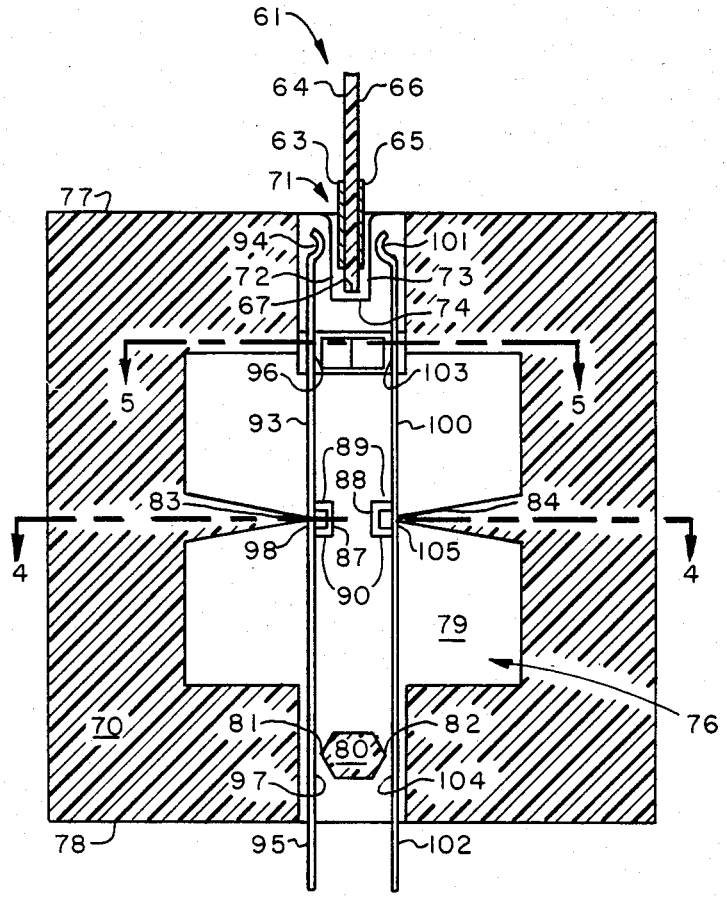
FIG. 3 is a cross sectional view of a second embodiment of a zero insertion force connection arrangement for establishing connection to a printed wiring board in accordance with the present invention.

Referring now to FIG. 3 there is shown a second arrangement for establishing connection to a printed wiring board 61. The printed wiring board 61 includes a first plurality of terminals 63 located on a first side 64 and a second plurality of terminals 65 located on a second side 66. The first terminals 63 and the second terminals 65 are located near an edge 67 of the printed wiring board 61.

Figure 4:
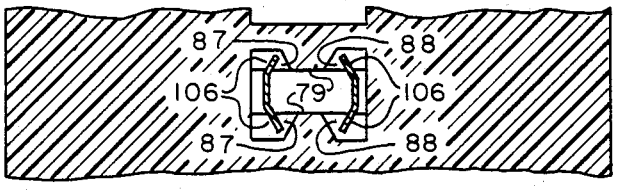
FIG. 4 is a sectional view taken along line 4—4 in FIG. 3.

A connector body 70 is provided with a groove 71 including a first wall 72, a second wall 73, and a floor 74. A plurality of spring receiving cavities 76 are formed in the connector body 70 in alignment with corresponding groups of one of each of the terminals 63 and 65. The cavities 76 extend between a first side 77 and a second side 78 of the connector body 70 and include a pair of parallel opposite walls 79 (such walls are shown in FIG. 4) and a connection spring terminal positioner 80 located centrally within each of the cavities 76 proximate the second surface 78. The positioner 80 includes a first fulcrum 81 and a second fulcrum 82. A third fulcrum 83 and a fourth fulcrum 84 are formed centrally located and between the opposite walls 79 of each of the spring receiving cavities 76.

Referring to FIG. 4, a first pair of recesses 87 and a second pair of recesses 88 are formed in the walls 79 of each of the spring receiving cavities 76 near the third and fourth fulcrums 83 and 84 respectively. Referring again to FIG. 3, each of the recesses 87 and 88 includes an upper edge 89 and a lower edge 90. Each of the spring receiving cavities 26 intersects the printed wiring board receiving groove 71.

Each of the spring receiving cavities 76 includes an elongated first connection spring 93 positioned therein. Each of the first springs 93 includes a contact 94, a terminal 95 positioned at opposite ends thereof. The contact 94 of each of the first springs 93 is positioned proximate to a corresponding one of the first contacts 63 of the first printed wiring board 61 and the terminal 95 extends beyond the second side 78 of the connector body 70 to permit connection to external points (not shown) by commonly known means (also not shown) such as wire connection. Each of the first springs 93 includes an actuator engaging area 96 and a first spring positioner pivot point 97 positioned on a side of the spring facing toward the printed wiring board 61, both the actuator engaging area and the positioner pivot point located between the contact 94 and the terminal 95. The first spring positioner pivot point 97 is located to engage the first fulcrum 81 of the spring positioner 80. A first spring pivot point 98 is positioned on a side of each of the first springs 93 facing away from the printed wiring board 61 and located between the actuator engaging area 96 and the spring positioner pivot point 97.

Similarly, each of the spring receiving cavities 76 includes a second connection spring 100 including a contact 101 positioned proximate to a corresponding one of the second terminals 65 of printed wiring board 61 and a terminal 102 extending beyond the second side 78 of the connector body 70 to permit connection to external points (not shown) by commonly known means (also not shown) such as wire connection. Each of the second springs 100 includes an actuator engaging area 103 and a second spring positioner pivot point 104 positioned on a side of the spring facing toward the printed wiring board 61, both the actuator engaging area and the positioner pivot point located between the contact 101 and the terminal 102. The second spring positioner pivot point 104 is located to engage the second pivot point 82 of the spring positioner 80. A second spring pivot point 105 is positioned on a side of the second spring 100 facing away from the printed wiring board 1 and located between the actuator engaging area 103 and the spring positioner pivot point 104. The spring pivot points 98 and 105 are positioned to engage fulcrums 83 and 84 respectively when the springs 93 and 100 are operated as described below.

Referring to FIG. 4, each of the first springs 93 and the second springs 100 includes a pair of retaining fingers 106 to retain each of the springs within each of their spring receiving cavities 76 while permitting spring movement about the spring pivot points 98 and 105 respectively. Referring again to FIG. 3, the pairs of retaining fingers 106 (see FIG. 4) are attached to each of the first springs 93 near each of the first spring pivot points 98 and to each of the second springs 104 near each of the second spring pivot points 105.

Figure 5:
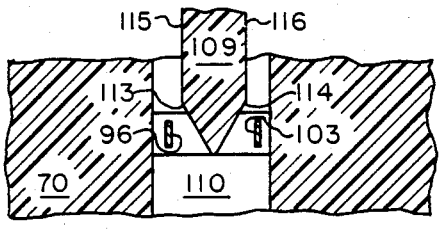
FIG. 5 is a sectional view taken along line 5—5 in FIG. 3.

Referring to FIG. 5, an actuator 109 is slidably positioned in a channel 110 between each of the first and second spring actuator engaging areas 96 and 103. The actuator 109 includes a first sloping ramp surface 113, a second sloping ramp surface 114, a first side surface 115 and a second side surface 116. The first sloping ramp 113 and the second sloping ramp 114 of the actuator 109 are arranged to engage and spread apart first and second spring actuator engaging areas 96 and 103 when the actuator is slid past them within its channel 110.

The connector of the present invention is operated by sliding the actuator 109 past each of the springs 93 and 100 to flex and pivot the springs and place the first side surface 115 in contact with the actuator engaging areas 96 and the second side surface 116 in contact with actuator engaging areas 103. In this position, the first springs 93 and the second springs 100 are in their actuated positions. The contacts 94 and 101 are out of engagement with the first contacts 63 and the second contacts 65 of the printed wiring board 61.

The printed wiring board 61 may now be inserted into the groove 71 with low insertion force to the point where the edge 67 abuts the groove floor 74. Once inserted, the first terminal 63 of the first printed wiring board 61 may be connected to the connection spring terminal 95 and the second terminal 65 of the first printed wiring board 61 may be connected to the connection spring terminal 102 by sliding the actuator 109. In this regard, the actuator 109 is slid within the channel 110 to remove the actuator engaging areas 96 from engagement with the first side surface 115. Once freed, the first spring 93 will flex and pivot about the pivot point 98 acting against the fulcrum 83 and the first spring positioner pivot point 97 acting against first fulcrum 81 to place the first contacts 94 into engagement with the first terminals 63. Similarly, the freed second spring 100 will flex and pivot about pivot point 105 acting against the fulcrum 84 and the second spring positioner pivot point 104 acting against second fulcrum 82 to place the contact 101 into engagement with the second terminal 65.

Positioning of the first springs 93 and the second springs 100 within each of the spring receiving cavities 76 is controlled by action of the first fingers 106 of the springs against the upper edges 89 and the lower edges 90 of the first and second recesses 87 and 88.

A variation of the present invention may be realized by rigidly retaining the terminals 41 and 47 in FIG. 1 and the terminals 95 and 102 in FIG. 3 so they do not move during actuation of the connector. In this regard, clearance around the terminals within the connector body may be decreased to a point just permitting insertion of the terminal within the connector body.

While a linear type of actuator has been described in the second embodiment, it will be appreciated that other types of actuators may be used to deflect the actuator engaging areas 96 and 103 away from each other to effect disengagement of the connector spring contacts from the printed wiring board terminals. In this regard, a rotary actuator (not shown) may be used. The actuator may include a pair of opposite low points and a pair of opposite high points, each low point between two high points and each low point connected to each adjacent high point along an outer surface of the actuator by cam areas. The rotary actuator may be inserted between the actuator engaging areas 96 and 103 and rotated to deflect the actuator engaging areas away from each other.

It will now be apparent that two embodiments of a low insertion force arrangement for establishing connection to a printed wiring board have been described hereinabove which provide improvements over prior art assemblies. The arrangement may use connection springs normally biased out of engagement with the printed wiring board according to the embodiment shown in FIGS. 1 and 2 or it may use connection springs normally biased in engagement with the printed wiring board as shown in the embodiment of FIGS. 3 through 5. Additionally, actuators may be associated with each set of connection springs in each of the described embodiments. The actuators may be positioned to simultaneously operate the springs, or they may be offset or separately operatable with respect to each other to sequentially operate each set of connection springs.

While but two embodiments of the present invention have been disclosed, it will be appreciated by those skilled in the art that numerous modifications of the present invention may be made without departing from the spirit of the invention which shall be limited only by the scope of the claims appended hereto.

What is claimed is:

1. In combination, a first printed wiring board including at least one terminal, and a low insertion force arrangement for establishing a connection to said printed wiring board, said arrangement comprising:

at least one connection spring, said spring including a contact, a pivot point, a connection spring terminal, and an acutator engaging area, said pivot point located between said contact and said actuator engaging area, said contact engageably positioned relative to said printed wiring board terminal and said connection spring terminal permitting connection to external points;

a fulcrum positioned to engage said spring at said pivot point; and an actuator located proximate to said spring at said actuator engaging area, said actuator positioned in a first position relative to said spring to pivot said spring and engage said contact with said printed wiring board terminal, and positioned in a second position relative to said spring to pivot said spring and disengage said contact from said printed wiring board terminal.

2. An arrangement as claimed in claim 1, wherein: said connection spring is of elongated construction.

3. An arrangement as claimed in claim 1, wherein: said contact is located on said spring facing said printed wiring board.

4. An arrangement as claimed in claim 1, wherein: said pivot point is located on said spring facing away from said printed wiring board.

5. An arrangement as claimed in claim 1, wherein: said actuator engaging area is located on said spring facing said printed wiring board.

6. An arrangement as claimed in claim 1, wherein: said connection spring is positioned generally parallel to and overlapping said printed wiring board terminals.

7. An arrangement as claimed in claim 2, wherein: said contact is positioned proximate an end of said spring.

8. An arrangement as claimed in claim 1, wherein: said actuator includes cam means located proximate to said actuator engaging area, said cam means engaging said actuator engaging area when said actuator is rotationally repositioned between said first and said second positions to pivot said spring.

9. An arrangement as claimed in claim 1, wherein: said actuator includes a sloping ramp positioned proximate said actuator engaging area, said ramp engaging said engaging area when said actuator is linearly repositioned between said first and said second actuator positions to pivot said spring.

10. An arrangement as claimed in claim 1, wherein: said connection spring terminal is located proximate an end of said spring.

11. In combination, a first printed wiring board including at least one terminal, and a low insertion force arrangement for establishing a connection to said printed wiring board, said arrangement comprising:

at least one connection spring, said spring including a contact, a first and a second pivot point, a connection spring terminal, and an actuator engaging area, said contact engageably positioned relative to said printed wiring board terminal and said connection spring terminal permitting connection to external points;

a first and a second fulcrum each positioned to engage said spring at a corresponding one of said pivot points;

an actuator located proximate to said spring at said actuator engaging area, said actuator positioned in a first position relative to said spring to pivot said spring and engage said contact with said printed wiring board terminal, and positioned in a second position relative to said spring to pivot said spring and disengage said contact from said printed wiring board terminal;

a connector body including a printed wiring board receiving cavity and at least one spring receiving cavity; said printed wiring board positioned within said printed wiring board receiving cavity and said connection spring positioned within said spring receiving cavity;

a first and second pair of retaining fingers connected to said spring at said first and second pivot points, respectively, said fingers extending in a direction away from said spring;

a pair of opposing walls included in said spring receiving cavity, each wall including a first and a second retainer recess, said first recesses formed opposite one another, said second recesses formed opposite one another, said first fingers positioned within said first recesses and said second fingers positioned within said second recesses, at least said first retainer recesses each of elongated construction, and said first and second retaining fingers cooperating with said first and second retaining recesses when said actuator is positioned to said first position relative to said spring to wipe said contacts against said printed wiring board terminals.

12. An arrangement as claimed in claim 11, wherein: said fulcrums are formed as part of said connector body.

13. An arrangement as claimed in claim 11, wherein: said printed wiring board includes at least one terminal formed on both sides of said printed wiring board, and said arrangement includes a plurality of connector springs each positioned within an associated one of said connector body spring receiving cavities.

14. An arrangement as claimed in claim 13, wherein: said actuator includes means to simultaneously pivot said connection springs.

15. In combination, a first printed wiring board including at least one terminal, and a low insertion force arrangement for establishing a connection to said printed wiring board, said arrangement comprising:

at least one connection spring, said spring including a contact, a pivot point, a connection spring terminal, and an actuator engaging area, said contact engageably positioned relative to said printed wiring board terminal and said connection spring terminal permitting connection to external points;

a fulcrum positioned to engage said spring at said pivot point;

an actuator located proximate to said spring at said actuator engaging area, said actuator positioned in a first position relative to said spring to pivot said spring and engage said contact with said printed wiring board terminal, and positioned in a second position relative to said spring to pivot said spring and disengage said contact from said printed wiring board terminal; and a second pivot point located on said spring facing said printed wiring board and a second fulcrum positioned to engage said second pivot point, said first pivot point located on said spring facing away from said printed wiring board and located between said second pivot point and said actuator engaging area, and said actuator engaging area located on said spring facing said printed wiring board and located between said first pivot point and said contact.

* * * * *